US008147050B2

(12) United States Patent
Nishida

(10) Patent No.: US 8,147,050 B2
(45) Date of Patent: Apr. 3, 2012

(54) LIQUID DROPLET JETTING APPARATUS

(75) Inventor: Katsunori Nishida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 321 days.

(21) Appl. No.: 12/533,237

(22) Filed: Jul. 31, 2009

(65) Prior Publication Data

US 2010/0026755 A1 Feb. 4, 2010

(30) Foreign Application Priority Data

Jul. 31, 2008 (JP) ..... 2008-197686

(51) Int. Cl.
*B41J 2/175* (2006.01)

(52) U.S. Cl. ..... 347/92

(58) Field of Classification Search ..... None
See application file for complete search history.

(56) References Cited

U.S. PATENT DOCUMENTS

| | | | | |
|---|---|---|---|---|
| 5,619,232 | A | 4/1997 | Maeno | |
| 7,131,720 | B2 * | 11/2006 | Mizuno et al. | 347/92 |
| 7,452,065 | B2 | 11/2008 | Ogawa | |
| 2004/0246294 | A1 | 12/2004 | Mitsuzawa | |
| 2008/0007605 | A1 | 1/2008 | Sakurai et al. | |

FOREIGN PATENT DOCUMENTS

| | | |
|---|---|---|
| EP | 0525988 | 6/1992 |
| JP | 5-016391 | 1/1993 |
| JP | 10-239510 | 9/1998 |
| JP | 2000-94706 | 4/2000 |
| JP | 2000-118004 | 4/2000 |
| JP | 2005-225184 | 8/2005 |
| JP | 2005-246928 | 9/2005 |
| JP | 2008-030433 | 2/2008 |
| JP | 2008-119886 | 5/2008 |
| WO | WO 94/13488 | 6/1994 |
| WO | WO 03/089246 | 10/2003 |

* cited by examiner

*Primary Examiner* — Matthew Luu
*Assistant Examiner* — Alejandro Valencia
(74) *Attorney, Agent, or Firm* — Frommer Lawrence & Haug LLP

(57) ABSTRACT

A liquid droplet jetting apparatus is capable of carrying out selectively a first purge mode and a second purge mode. In the first purge mode, a first air discharge purge of discharging air in an ink storage chamber is carried out while maintaining a meniscus of the ink. In the second purge mode, a second air discharge purge of discharging air inside the ink storage chamber is carried out while destroying the meniscus of the ink. Accordingly, there is provided a liquid droplet jetting apparatus in which it is possible to discharge a gas inside a liquid supply channel from an upstream side of the nozzle, and also, when the degree of thickening of the liquid inside the nozzle is extreme, it is possible to discharge the thickened liquid assuredly from the nozzle.

11 Claims, 10 Drawing Sheets

LIQUID DROPLET JETTING APPARATUS

CROSS REFERENCE TO RELATED APPLICATION

The present application claims priority from Japanese Patent Application No. 2008-197686, filed on Jul. 31, 2008, the disclosure of which are incorporated herein by reference in their entirety.

BACKGROUND OF THE INVENTION

1. Field of the Invention

The present invention relates to a liquid droplet jetting apparatus which jets liquid droplets of a liquid.

2. Description of the Related Art

As a liquid droplet jetting apparatus which jets liquid droplets from nozzles, an ink-jet printer which includes an ink-jet head which jets droplets of an ink onto a recording paper has hitherto been known. In such an ink-jet printer, due to entry of an air bubble into an ink channel or due to increase in the viscosity (due to thickening) of the ink inside the nozzle caused by the drying of the ink, nozzle jetting failure occurs in some cases. To address this situation, an ink-jet recording apparatus of general type is provided with a unit or device which discharges the air bubble and/or the thickened ink inside the ink channel to thereby recover the jetting performance of the nozzles.

The applicant of the present patent application has proposed an ink-jet printer capable of performing (carrying out) a suction purge in which air bubbles and/or thickened ink are forcibly discharged by suction (suction-discharged) from a nozzle positioned at a terminal end portion of the ink channel, and an air discharge purge in which the air bubble is suction-discharged from a portion of the ink channel located at an upstream side of the nozzle. For example, a certain ink-jet printer includes, as the construction for the suction purge, a nozzle cap which closes a jetting port of the nozzle by making a tight or close contact with a liquid droplet jetting surface of an ink-jet head. In addition, the ink-jet printer includes, as the structure for the air discharge purge, a buffer tank having an air bubble storage (accommodating) chamber which communicates with the ink-jet head, a discharge channel which is extended from the air bubble storage chamber, an opening/closing valve which opens and closes the discharge channel, and an air discharge cap which closes an end portion (a discharge port) of the discharge channel. Further, the nozzle cap and the air discharge cap are connected to the suction pump via a switching unit.

In the above-described ink-jet printer, by operating the suction pump in a state that the jetting port of the nozzle is closed by the nozzle cap, the ink including the thickened ink and/or air bubble is discharged by suction from the nozzle into the nozzle cap. On the other hand, by operating the suction pump in a state that the air discharge port of the discharge channel is closed by the air-discharge cap and that the discharge channel is opened by the opening/closing valve, air bubble in the air bubble storage chamber in the buffer tank positioned at the upstream side of the nozzle is discharged from the air bubble storage chamber to the air discharge cap via the discharge channel. By performing this air discharge purge, it is possible to reduce a suction time and a frequency of the suction purge performed for discharging the air bubble, thereby making it possible to suppress the ink consumption amount.

SUMMARY OF THE INVENTION

In the above-described ink-jet printer, in a case that there occurs jetting defect or jetting failure mainly due to the thickening of the ink in the nozzle, the suction purge is carried out to discharge the thickened ink from the nozzle. However, in a case that the thickening of the ink in the nozzle is extreme (severe) due to a such reason that a state that the power supply of the printer is OFF has continued for a long period of time, it is difficult to readily destroy the meniscus of the thickened ink formed in the nozzle by a normal suction purge, and it is difficult to discharge the thickened ink from the nozzle.

An object of the present invention is to provide a liquid droplet jetting apparatus capable of discharging a gas, entered into and mixed with a liquid supply channel, from an upstream side of the nozzle, and capable of discharging assuredly the thickened liquid from the nozzle in a case that the degree of thickening of the liquid inside the nozzle is extreme.

According to a first aspect of the present invention, there is provided a liquid droplet jetting apparatus which jets droplets of a liquid, including a liquid droplet jetting head having nozzles which jet the liquid droplets, and in each of which a meniscus of the liquid is formed at an end of the each of the nozzles;

a liquid supply channel through which the liquid is supplied to the liquid droplet jetting head;

an air-discharge channel which communicates with the liquid supply channel;

a purge mechanism which performs a liquid purge of discharging the liquid from the nozzles of the liquid droplet jetting head;

a suction mechanism which is connected to the air discharge channel; and a controller which controls the purge mechanism and the suction mechanism to selectively perform a first purge mode in which the control mechanism controls the suction mechanism to perform a first air-discharge purge of discharging an air inside the liquid supply channel via the air-discharge channel while maintaining the meniscus of the liquid in the nozzles, and a second purge mode in which the control mechanism controls the suction mechanism to perform a second air-discharge purge of discharging the air inside the liquid supply channel via the air-discharge channel while destroying the meniscus of the liquid in the nozzle and then the control mechanism controls the purge mechanism to perform the liquid purge.

In a case that a gas such as air has entered into the liquid supply channel connected to the liquid droplet jetting head, it is difficult to discharge all the gas from the nozzle located at the terminal end portion of the liquid supply channel, and further, even when the gas can be discharged successfully, an amount of liquid, which is discarded together with or simultaneously with the gas from the nozzle, becomes substantial. Therefore, in such a case, the first purge mode in which the gas can be discharged from the upstream side of the nozzle is selected. At first, by carrying out the first air discharge purge by the suction mechanism, a substantial portion of the gas entered into the liquid supply channel is discharged from the air discharge channel communicating with the liquid supply channel at the upstream side of the nozzle. Afterwards, by carrying out the liquid purge by the purge mechanism as necessary, the liquid is discharged from the nozzle while discharging air bubbles in the liquid and/or a thickened liquid inside the nozzle, which have not been discharged by the air discharge purge, are discharged simultaneously with the discharged liquid.

On the other hand, when the degree of thickening of liquid in the nozzle is extreme, and it is difficult to discharge the thickened liquid inside the nozzle only by carrying out the liquid purge, the second purge mode which is specialized for the discharge of the thickened liquid is selected. In this case, the second air discharge purge is carried out so as to destroy the meniscus of the liquid thickened inside the nozzle. For example, the meniscus of the liquid thickened inside the nozzle is destroyed by carrying out a strong suction (high-speed suction), in which a suction speed (suction force) is greater than a suction speed in the air discharge purge, from the air discharge channel communicating with the liquid supply channel, and by rapidly reducing a pressure inside the liquid supply channel. The meniscus of the liquid thickened inside the nozzle is destroyed by the second air discharge purge. Therefore, when the liquid purge is carried out after the second air discharge purge, it is possible to easily discharge the thickened liquid inside the nozzle.

In the present invention, the term "liquid purge" is a purge to be carried out for the purpose of discharging the liquid from the nozzle. However, in the liquid purge, what is discharged from the nozzle actually is not limited to the liquid only, and a gas entered into (mixed with) the liquid may also be discharged from the nozzle together with the liquid. Further, the term "first air discharge purge" is a purge carried out for the purpose of discharging the gas from the air discharge channel. However, in practice, what is discharged from the air discharge channel is not limited only to the gas, and the liquid may also be discharged together with (mixed with) the gas. Similarly, in the meaning of the term "second air discharge purge" also, the liquid may be discharged together with the gas from the air discharge channel.

BRIEF DESCRIPTION OF THE DRAWINGS

FIG. 6 is a flowchart related to a maintenance operation to be carried out immediately after power supply is switched on;

FIGS. 7A and 7B are diagrams showing an operation of a maintenance unit when a first purge mode is selected, wherein FIG. 7A shows a state when a first air discharge purge is carried out and FIG. 7B shows a state when a liquid purge is carried out;

FIGS. 8A and 8B are diagrams showing an operation of the maintenance unit when a second purge mode is selected, wherein FIG. 8A shows a state when a high-speed suction is carried out and FIG. 8B shows a state when a liquid purge is carried out;

DETAILED DESCRIPTION OF THE PREFERRED EMBODIMENTS

An exemplary embodiment of the present invention will be described below. The embodiment is an example in which the present invention is applied to a printer which records a desired image and/or characters on a recording paper by jetting droplets of an ink onto a recording paper from an ink-jet head.

Figure 1:
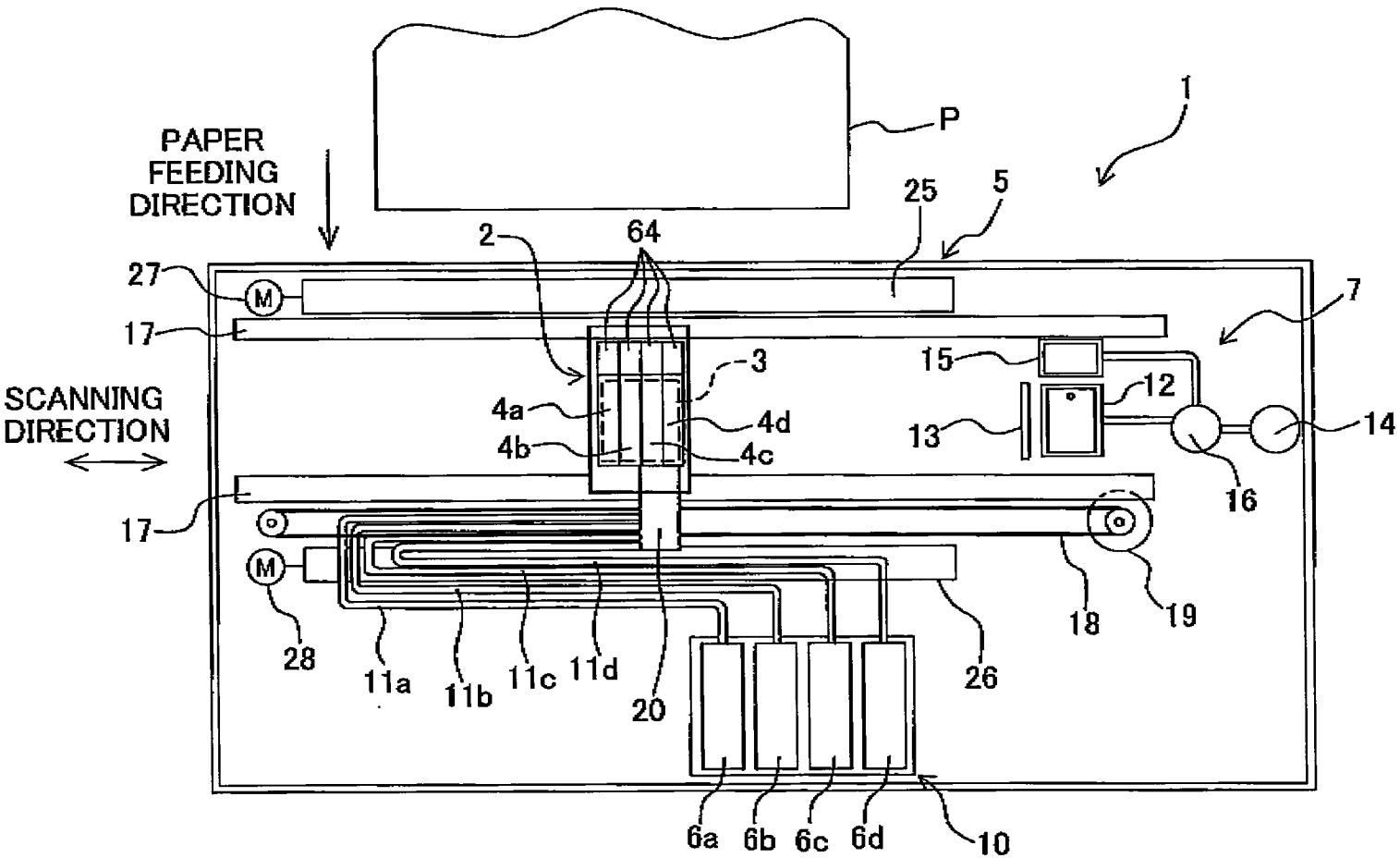
FIG. 1 is a schematic view showing the construction of a printer according to an embodiment of the present invention.
Figure 5:
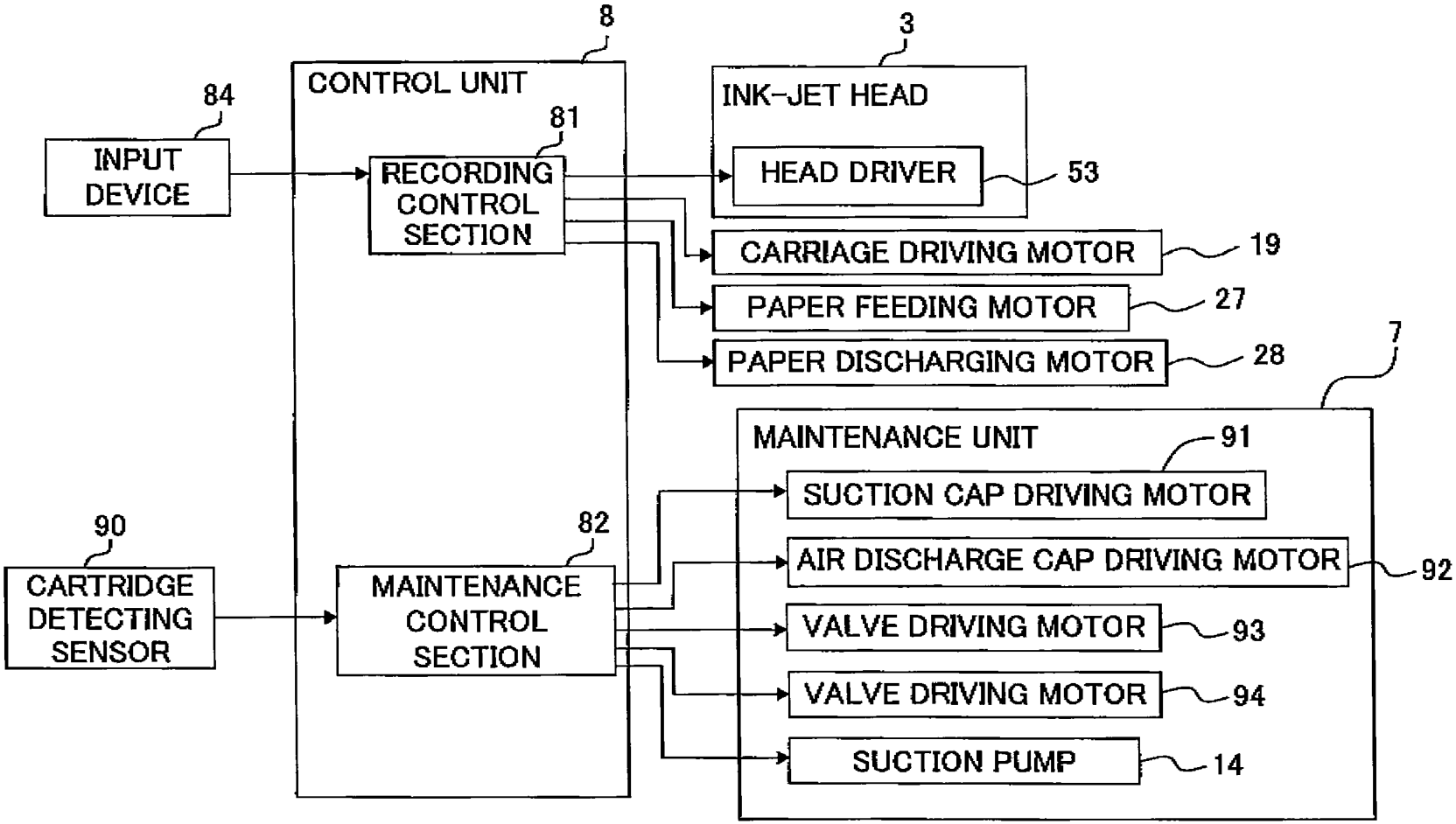
FIG. 5 is a block diagram showing the electrical structure of the printer.

As shown in FIG. 1, a printer 1 (a liquid droplet jetting apparatus) includes a carriage 2 which is formed to be reciprocatable along one direction, sub tanks 4*a*, 4*b*, 4*c*, and 4*d* and an ink-jet head 3 (a liquid droplet jetting head) mounted on the carriage 2, a transporting mechanism 5 which transports a recording paper P in a paper feeding direction in FIG. 1, ink cartridges 6*a*, 6*b*, 6*c*, and 6*d* which store inks, a maintenance unit 7 which recovers a liquid droplet jetting performance of the ink-jet head 3 when the jetting performance is degraded, and a control unit (controller) 8 which controls various sections of the printer 1 (refer to FIG. 5).

The carriage 2 is reciprocatable along two guide shafts 17 extended parallel to a left-right direction (scanning direction) in FIG. 1. Moreover, an endless belt 18 is coupled with the carriage 2, and when the endless belt 18 is driven by a cage driving motor 19, the carriage 2 moves in the left-right direction with the movement of endless belt 18.

The ink-jet head 3 and four sub tanks 4*a* to 4*d* are mounted on the carriage 2. The ink-jet head 3 jets droplets of ink onto the recording paper P, which is transported downward (paper feeding direction) in FIG. 1 by the sporting mechanism, from nozzles 40 provided in a lower surface (surface facing a paper surface in FIG. 1) of the ink-jet head 3, while reciprocating in the scanning direction together with the carriage 2 (refer to FIG. 2). Accordingly, the desired characters or an image are recorded on the recording paper P.

The four sub tanks 4*a* to 4*d* are aligned in the scanning direction. A tube joint 20 is provided integrally to the four sub tanks 4*a* to 4*d*. The four sub tanks 4*a* to 4*d* and the four ink cartridges 6*a* to 6*d* are connected via flexible tubes 11*a*, 11*b*, 11*c*, and 11*d* which are coupled with the tube joint 20, respectively. Four air-discharge units 64 for discharging air accumulated in the sub tanks 4*a* to 4*d* are provided in the four sub tanks 4*a* to 4*d* at one end portion in the paper feeding direction. Details of the air discharge units 64 will be described later.

The transporting mechanism 5 has a paper feeding roller 25 which is arranged at an upstream side in the paper feeding direction with respect to the ink-jet head 3, and a paper discharge roller 26 which is arranged at a downstream side in the paper feeding direction with respect to the ink-jet head 3. The paper feeding roller 25 and the paper discharge roller 26 are driven by a paper feeding motor 27 and a paper discharging motor 28 respectively. Moreover, the transporting mechanism 5 transports a recording paper P to supply to the ink-jet head 3 from an upper side in FIG. 1, by the paper feeding roller 25, and discharges the recording paper P, onto which an image or the like is recorded by the ink-jet head 3, to a lower side in FIG. 1 by the paper discharge roller 26.

Inks of four colors namely magenta, cyan, yellow, and black are stored in the four ink cartridges 6*a* to 6*d* respectively, and the ink cartridges 6*a* to 6*d* are detachably mounted on a holder 10. Although it is not shown in FIG. 1, a cartridge detecting sensor 90 (refer to FIG. 5) which detects whether or not the four ink cartridges 6*a* to 6*d* are mounted, is provided to the holder 10. It is possible to use a sensor such as an optical sensor having a light emitting element and a light receiving element, as the cartridge detecting sensor 90. In this case, when one of the ink cartridges 6*a* to 6*d* is mounted on the holder 10, the light from the light emitting element corresponding to the one of the ink cartridges is shielded. Therefore, it is possible to detect whether or not any one of the ink cartridges 6*a* to 6*d* is mounted. Or, a sensor of a so-called contact-point type may also be used. In this case, when the ink cartridges 6*a* to 6*d* are mounted on the holder 10, a contact point provided at the holder 10 and another contact point provided at the ink cartridges 6*a* to 6*d* make a contact. In this manner, an arrangement may be made such that the ink cartridges 6*a* to 6*d* are detected by detecting whether or not the two contact points are brought into conduction.

The inks of four colors stored in the four ink cartridges 6*a* to 6*d* are supplied to the ink-jet head 3 after the four color inks are stored temporarily in the sub tank 4*a* to 4*d*. In other words, ink supply channels through which the inks are supplied to the ink-jet head 3 include the four sub tanks 4*a* to 4*d*, and the four tubes 11*a* to 11*d* which connect the four sub tanks 4*a* to 4*d* and the four ink cartridges 6*a* to 6*d*.

The maintenance unit 7 restores a jetting performance of the ink-jet head 3 by making the ink-jet head 3 discharge the ink forcibly from the nozzles 40, and is arranged in an area (a maintenance position) at an outer side (right side in FIG. 1) of a printing area facing the recording paper P, within a range of movement of the carriage 2 in the scanning direction. Details of the maintenance unit 7 will be described later.

Next, the ink-jet head 3 and the sub tanks 4*a* to 4*d* will be described below. Since a structure of the four sub tanks 4*a* to 4*d* storing the inks of four colors respectively is basically the same, one of the sub tanks (sub tank 4*a*) will be described below.

Figure 2:
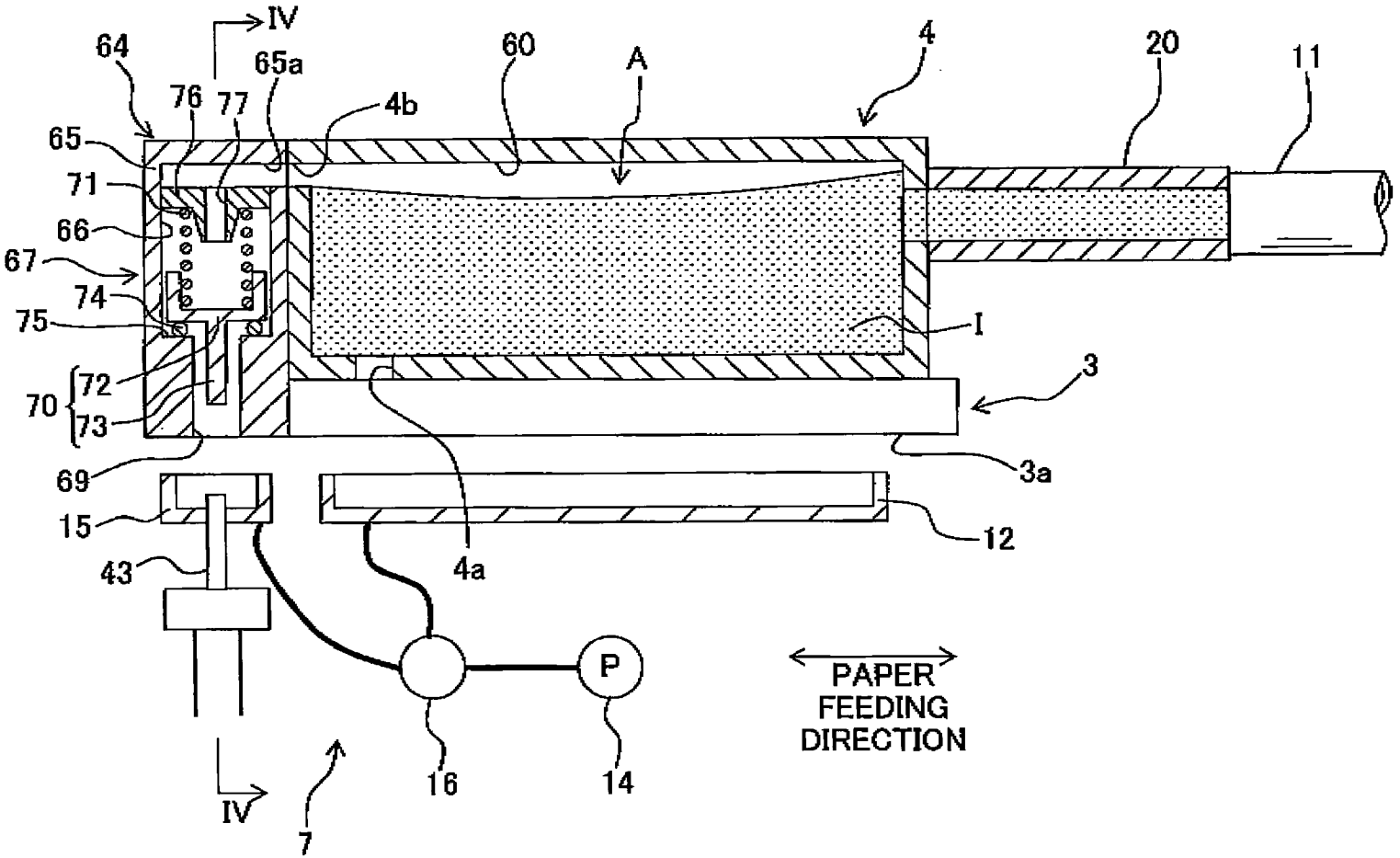
FIG. 2 is a cross-sectional view of a sub tank, an ink-jet head and a maintenance unit when a carriage is at a maintenance position, taken along a perpendicular plane which is orthogonal to a scanning direction.

As shown in FIG. 2, an ink storage chamber 60 is provided inside the sub tank 4*a*. The ink storage chamber 60 communicates with one of the ink cartridges 6*a* via one of the tubes 11*a* made of a synthetic resin material connected to the tube joint 20 (refer to FIG. 1). An ink supply hole 104*a* is formed in a bottom portion of the sub tank 4*a*. The ink I (see FIG. 2) supplied from the ink cartridges 6*a* to the sub tank 4*a* via the tube 11*a* after being stored temporarily in the ink storage chamber 60, is supplied to the ink-jet head 3 through the ink supply hole 104*a*.

Figure 4:
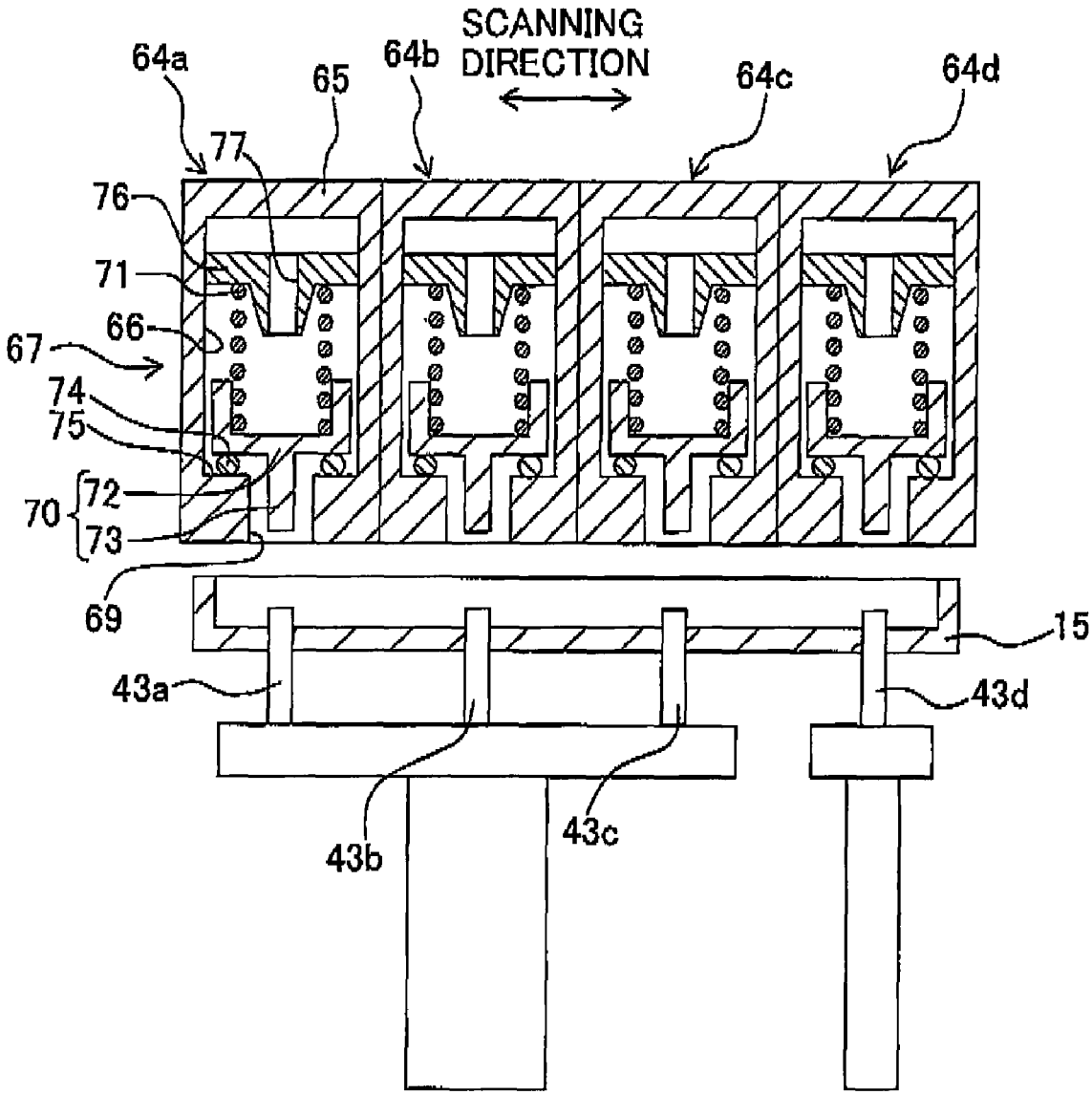
FIG. 4 is a cross-sectional view taken along a line IV-IV in FIG. 2.

When air enters into the ink supply channel made of the sub tank 4*a* and the tube 11*a*, a substantial part of the air (see reference numeral "A" in FIG. 2), as shown in FIG. 4, accumulates at an upper portion of the ink storage chamber 60. The air discharge unit 64 which discharges air accumulated inside the ink storage chamber 60 together with the maintenance unit 7 is provided at an end portion of the upstream side of the sub tanks 4*a* in the paper feeding direction (opposite side of the tube joint 20). The upper portion of the ink storage chamber 60 and an air discharge channel 66 at an interior of (an air discharge channel 66 inside) the air discharge unit 64 communicate via a through hole 104*b* provided at an upper end portion of a side wall of the sub tank 4. A concrete structure of the air discharge unit 64 will be described later.

Figure 3:
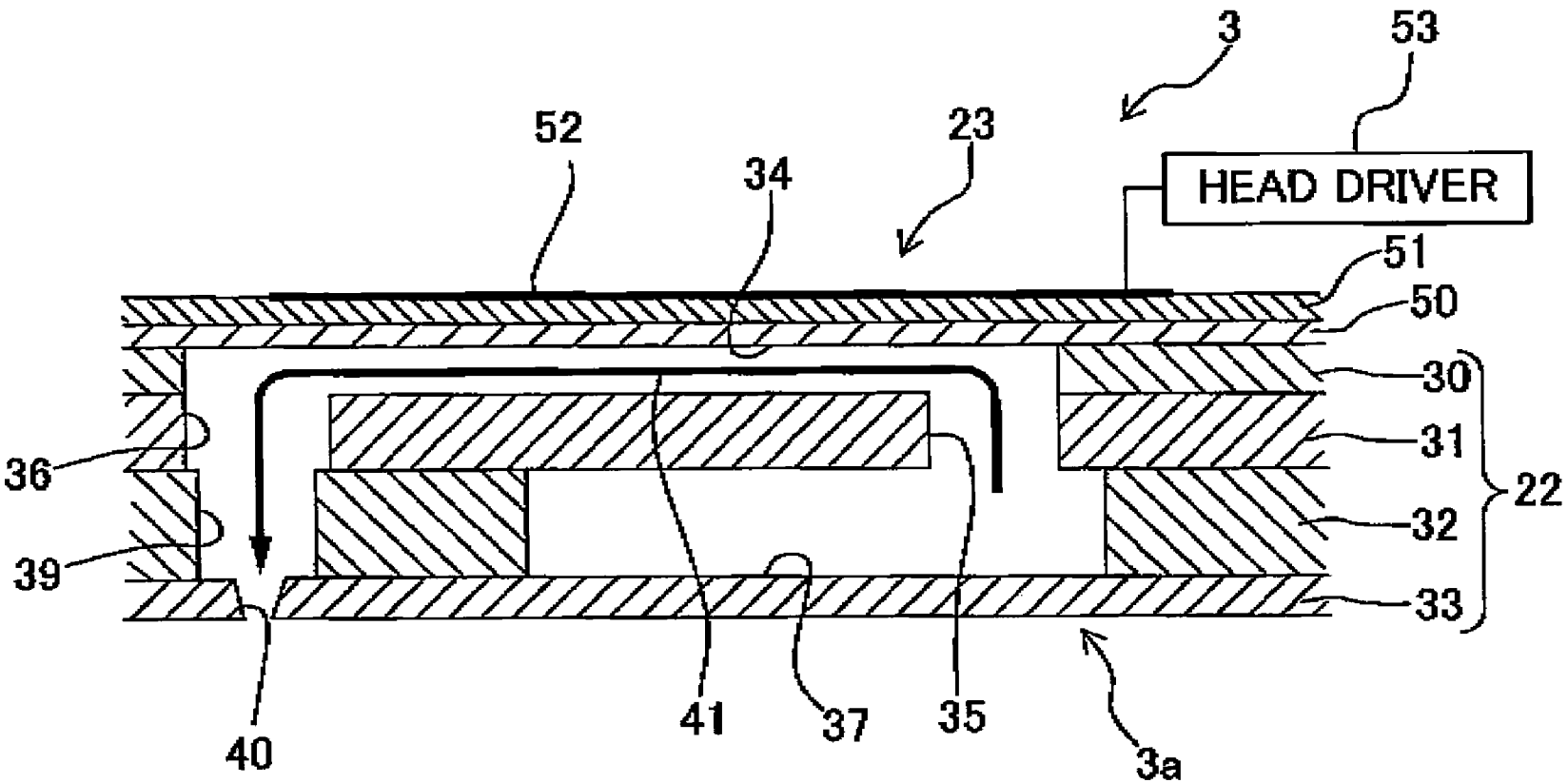
FIG. 3 is a vertical cross-sectional view of a part of the ink-jet head.

As shown in FIG. 3, the ink-jet head 3 includes a channel unit 22 in which ink channels including the nozzles 40 and pressure chambers 34 are formed, and a piezoelecic actuator 23 which applies a pressure to the ink in the pressure chambers 34 to jet the ink from the nozzles 40 of the channel unit 22.

The channel unit 22 includes a cavity plate 30, a base plate 31, and a manifold plate 32 made of a metallic material such as stainless steel, and a nozzle plate 33 made of an insulating material (a high-molecular synthetic resin material such as polyimide). The cavity plate 30, the base plate 31, the manifold plate 32, and the nozzle plate 33 are joined in a stacked state.

A plurality of pressure chambers 34 are formed in the cavity plate 30. The pressure chambers 34 are arranged in a row in a direction perpendicular to a paper surface in FIG. 3. Communicating holes 35 and 36 which communicate with the pressure chambers 34 are formed in the base plate 31. Moreover, a manifold 37 to which the ink is to be supplied from the ink storage chamber 60 of the sub tanks 4*a* to 4*d* described above, and which communicates with the plurality of pressure chambers 34 via the communicating hole 35, and a communicating hole 39 which communicates with the communicating hole 36 are formed in the manifold plate 32. Furthermore, the plurality of nozzles 40 is formed in the nozzle plate 33, and the nozzles 34 are arranged in a row in the direction perpendicular to the paper surface in FIG. 3, corresponding to the plurality of pressure chambers 34. A lower surface of the nozzle plate 33 is a liquid droplet jetting surface 3*a* in which jetting ports of the plurality of nozzles 40 is formed. A plurality of individual ink channels 41 (starting) from the manifold 37 reaching up to the nozzles 40 via the pressure chambers 34 is formed in the channel unit 22.

As shown in FIG. 3, the piezoelectric actuator 23 includes a vibration plate 50 made of a metal (metallic material) which is joined to an upper surface of the channel unit 22 to cover the plurality of pressure chambers 34, a piezoelectric layer 51 which is arranged on an upper surface of the vibration plate 50, and a plurality of individual electrodes 52 formed on an upper surface of the piezoelectric layer 51.

The vibration plate 50 which is made of a metallic material is kept at a ground electric potential all the time by a head driver 53. Moreover, the piezoelectric layer 51 is made of a piezoelectric material which is principally composed of lead zirconate titanate (PZT) which is a solid solution of lead titanate and lead zirconate, and which is a ferroelectric substance. The piezoelectric layer 51 is arranged on the upper surface of the vibration plate 50, to cover whole of the plurality of pressure chambers 34 continuously. The individual electrodes 52 are arranged on the upper surface of the piezoelectric layer 51, in an area facing a central portion of the pressure chambers 34. One of the ground electric potential and a predetermined driving electric potential which is different from the ground electric potential is applied to the individual electrodes 52 by the head driver 53.

An operation (action) of the piezoelectric actuator at the time of jetting of liquid droplets will be described below. In a case of jetting ink droplets from a certain nozzle 40, a driving electric potential is applied from the head driver 53 to the individual electrode 52 corresponding to the pressure chamber 34 which communicates with that nozzle 40. As the driving electric potential is applied to this individual electrode 52, an electric potential difference is generated between the individual electrode 52 to which the driving electric potential is applied and the vibration plate 50 which is kept at the ground electric potential, and an electric field in a direction parallel to a direction of thickness is generated in the piezoelectric layer 51 sandwiched between the individual electrode 52 and the vibration plate 50. Here, when the direction of the electric field is same as a direction in which the piezoelectric layer 51 is polarized, the piezoelectric layer 51 extends (elongates) in the direction of thickness and contracts in a planar direction. With the contraction deformation (deformation due to contraction) of the piezoelectric layer 51, a portion of the vibration plate 50 facing the pressure chamber 34 is deformed to form a projection toward the pressure chamber 34 (unimorph deformation). At this time, due to a decrease in a volume of the pressure chamber 34, a pressure on the ink inside the pressure chamber 34 rises up (increases) and the ink is jetted from the nozzle 40 communicating with the pressure chamber 34.

Next, the air discharge unit 64 provided to the sub tank 4 will be described below. As shown in FIGS. 1 and 2, the air discharge unit 64 is provided at one-end side (an end portion on an opposite side of the tube joint 20) in the paper feeding direction of the sub tank 4. As shown in FIG. 4, four air discharge units 64*a* to 64*d* are provided corresponding to the four sub tanks 4*a* to 4*d* respectively, which store inks of four colors (namely magenta, cyan, yellow, and black) respectively.

Since a structure of the four air discharge units 64*a* to 64*d* corresponding to the four sub tanks 4*a* to 4*d* respectively is concretely the same, one of the four air discharge units 64*a* to 64*d* (hereinafter referred as 'air discharge unit 64') will be described below. As shown in FIG. 2 and FIG. 4, the air discharge unit 64 includes a case 65 which is fixed to a side surface of the sub tank 4, the air discharge channel 66 which is extended in a vertical direction inside the case 65, and which communicates with the ink storage chamber 60 at an upper end thereof, and a valve 67 which opens and closes the air discharge channel 66.

As shown in FIG. 2, a through hole 65*a* is formed in a side wall at an upper-end portion of the case 65. An upper end of the air discharge channel 66 inside the case 65 communicates with the upper portion of the ink storage chamber 60, which forms an ink supply channel to the ink-jet head 3, via the through hole 65*a*, via the through hole 104*b* formed in the side wall of the sub tank 4. Moreover, the air discharge channel 66 is extended from an upper end communicating with the ink storage chamber 60 up to an air discharge port 69 which is formed at a lower end of the case 65.

The valve 67 includes a valve member 70 which is installed to be movable in a vertical direction, inside the air discharge channel 66, and which is capable of closing the air discharge channel 66, and a coil spring 71 which applies a bias to the valve member 70 downward (a direction of closing the air discharge channel 66).

The valve member 70 has a valve disc (valve element) 72 in the form of a bottomed-cylinder which is movable in the vertical direction in the air discharge channel 66, and a valve stern 73 which is extended downward from a bottom portion of the valve disc 72. An outer diameter of the valve disc 72 is smaller than an inner diameter of the air discharge channel 66, and the ink can flow between the valve disc 72 and an inner wall surface of the air discharge channel 66. Moreover, a seal member (a sealing member) 74 in the form of a ring is installed on a lower surface of the valve disc 72. The valve disc 72 makes a contact with a valve-seat surface 75 provided at a stage portion which is half way of the air discharge channel 66 via the seal member 74, and closes the air discharge channel 66.

A spring retaining portion (a spring bearing portion) 76 is provided to be fixed at an interior of an upper end portion of the case 65. A through hole 77 is formed in the spring receiving portion 76, and an upper space and a lower space of the spring retaining portion 76 communicate via the through hole 77. Moreover, a coil spring 71 is arranged in a compressed state, between the valve disc 72 of the valve member 70 and the spring retaining portion 76. The valve member 70 is biased downward (in the direction of closing the air discharge channel 66) by the coil spring 71. When the valve disc 72 is driven upward resisting the bias of the coil spring 71, by an open-close member 43, the valve disc 72 is separated away from the valve-seat surface 75, and the air discharge channel 66 is opened.

Next, the maintenance unit 7 will be described below. As shown in FIGS. 1, 2, and 4, the maintenance unit 7 includes a suction cap 12 which is capable of making a close contact with the liquid droplet jetting surface 3*a* (lower surface) of the ink-jet head 3, a wiper 13 which is arranged adjacent to the suction cap 12, in the scanning direction, an air discharge cap 15 which is capable of making a close contact with a lower surface of the four air discharge units 64*a* to 64*d*, a suction pump 14 which is connected to both the suction cap 12 and the air discharge cap 15, and the four open/close members 43 provided to the air discharge cap 15, which open and close the four valves 67 respectively.

The suction cap 12 is formed of a flexible material such as rubber and a synthetic resin material. As shown in FIG. 2, when the carriage 2 (the ink-jet head 3) has moved to the maintenance position, the suction cap 12 faces the liquid droplet jetting surface 3*a* in which the jetting ports of the nozzles 40 are arranged, which is the lower surface of the ink-jet head 3. In this state, when the suction cap is driven upward by a driving mechanism (not shown in the diagram) including a suction cap driving motor 91 (refer to FIG. 5), the suction cap 12 makes a close contact with the liquid droplet jetting surface 3*a* of the ink-jet head 3, and covers the jetting ports of the nozzles 40.

The air discharge cap 15 also, like the suction cap 12, is formed of a flexible material such as rubber and a synthetic resin material. As shown in FIG. 1, the air discharge cap 15 is arranged at a position on the upstream side in the paper feeding direction with respect to the suction cap 12, and when the carriage 2 (the ink-jet head 3) has moved to the maintenance position, the air discharge cap 15 faces the lower surface of the four air discharge units 64 (64*a* to 64*d*) as shown in FIG. 2. In this state, when the air discharge cap 15 is driven upward (frontward side of the paper surface in FIG. 1) by a driving mechanism (not shown in the diagram) including an air discharge cap driving motor 92 (refer to FIG. 5), the air discharge cap 15 makes a contact with the lower surface of the air discharge unit 64, and covers the air discharge ports 69 of the four air discharge units 64 (64*a* to 64*d*) respectively at the same time.

The four open-close members 43 (43*a* to 43*d*) are members in the form of a rod extended in the vertical direction, and are aligned at an interval in the scanning direction as shown in FIG. 4. Moreover, the four open-close members 43 are inserted through a bottom wall of the air discharge cap 15, maintaining the air-tight state, and are relatively movable vertically (up and down) with respect to the air discharge cap 15. When the carriage 2 (the ink-jet head 3) has moved to the maintenance position, the four open-close members 43 (43*a* to 43*d*) are positioned directly under (beneath) the air discharge ports 69 in the lower surface of the corresponding air discharge unit 64 as shown in FIGS. 2 and 4.

As shown in FIG. 4, the open-close member 43*d* corresponding to the air discharge unit 64*d* for the black ink is movable independently in the vertical direction. Whereas, the three open-close members 43*a* to 43*c* corresponding to the air discharge units 64*a* to 64*c* respectively for the three color inks (namely magenta, cyan, and yellow) are connected mutually at a lower-end portion thereof, and the three open-close members 43*a* to 43*c* are movable integrally in the vertical direction. Furthermore, the open-close member 43*d* for the black ink, and the open-close members 43*a* to 43*c* for the color inks which are connected mutually are driven up and down independently by two driving mechanisms (not shown in the diagram) including two valve driving motors 93 and 94 respectively (refer to FIG. 5).

With the air discharge port 69 in the lower surface of the air discharge unit 64 being covered by the air discharge cap 15, when the open-close member 43 moves upward with respect to the air discharge cap 15, an upper-end portion of the open-close member 43 is inserted into the air discharge channel 66 from the air discharge port 69, and then the valve stem 73 inside the air discharge channel 66 is pushed upward. As the valve stem 73 is pushed upward, the valve disc 72 moves upward integrally with the valve stem 73, and is separated (is driven away) from the valve-seat surface 75, and the air discharge channel 66 is opened.

The suction pump 14 is connected to the suction cap 12 and the air discharge cap 15 by tubes, via a switching unit 16. Firstly, a liquid purge in which thickened ink inside the nozzles 40 and an air bubble entered into the ink channel in the ink-jet head are discharged forcibly from the nozzles 40 together with the ink will be described below. At the time of carrying out the liquid purge, the jetting ports of the nozzles 40 are covered by bringing the suction cap 12 in close contact with the liquid jetting surface 3*a* of the ink-jet head 3, and a destination of communication of the suction pump 14 is switched to the suction cap 12 by the switching unit 16, and a suction operation of the suction pump 14 is carried out. In this case, air in a sealed space formed by the suction cap 12 and the liquid droplet jetting surface 3*a* is sucked and a pressure is decreased, and the ink is discharged from the nozzles 40 to the suction cap 12. Accordingly, it is possible to discharge the thickened ink inside the nozzles 40 and the air bubble which has entered into the ink channel in the ink-jet head 3, from (through) the nozzles 40 together with the ink.

Moreover, after the liquid purge, when the suction cap 12 is separated away from the liquid droplet jetting surface 3*a* of the ink-jet head 3, a part of the ink discharged from the nozzle is adhered to the liquid droplet jetting surface 3*a*. Therefore, when the ink-jet head 3, from this state, moves together with the carriage 2 in the scanning direction with respect to the wiper 13, the wiper 13 which is arranged adjacent to the suction cap 12, in the scanning direction, wipes off the ink adhered to the liquid droplet jetting surface 3*a*.

Next a first air discharge purge in which the air in the upper portion of the ink storage chamber of the sub tank is discharged through the air discharge channel will be described below. The air discharge port 69 is covered by bringing the air discharge cap 15 in close contact with the lower surface of the air discharge unit 64, and a destination of communication of the suction pump is switched to the air discharge cap 15 by the switching unit 16. Furthermore, with the air discharge channel 66 being opened by the open-close member 43, the suction operation of the suction pump 14 is carried out. At this time, air inside a sealed space formed by the air discharge cap 15 and the lower surface of the air discharge unit 64 is sucked, and a pressure is decreased. At this time, air accumulated in the upper portion of the ink storage chamber 60 of the sub tank 4 is discharged via (through) the air discharge channel 66 (the first air discharge purge).

Furthermore, in the embodiment, it is possible to make the suction pump 14 carry out a second air discharge purge (hereinafter called as a 'high-speed suction') in which a suction operation with a suction speed higher (more) than a suction speed at the time of carrying out the first air discharge purge, is made to carry out by the suction pump 14. As it will also be described later, the high-speed suction, unlike the first air discharge purge which is carried out solely with an object of discharging the air inside the ink storage chamber, is a purge which is carried out with a main object of destroying intentionally the meniscus of the thickened ink in the nozzles 40 by reducing rapidly the pressure inside the ink storage chamber 60 via the air discharge channel 66. In other words, in the first air discharge purge, the air inside the sealed space formed by the air discharge cap 15 and the lower surface of the air discharge unit 64 is sucked gradually so that the meniscus of the ink formed at the front end of the nozzle 40 is not destroyed. To put in still other words, the suction is carried out such that a pressure difference between a pressure exerted to the front end of the nozzle 40 (normally an atmospheric pressure), and the pressure of (inside) the sealed space (air discharge channel 66) becomes smaller than a withstand pressure (resisting pressure) of the meniscus. Whereas, in the high-speed suction, the air inside the sealed space formed by the air discharge cap 15 and the lower surface of the air discharge unit 64 is sucked in order to destroy the meniscus of the ink formed at the front end of the nozzle 40. In other words, the suction is carried out such that the pressure difference between the pressure exerted to the front end of the nozzle (normally the atmospheric pressure) and the pressure of the sealed space (air discharge channel 66) is higher an the withstand pressure (resisting pressure) of the meniscus. In the embodiment such suction is realized by sucking the sealed space at a high speed. Consequently, by carrying out the liquid purge after the high-speed suction is carried out, it is possible to discharge easily the thickened ink inside the nozzle 40.

In the embodiment, the suction pump 14 is a part of a purge mechanism for carrying out the liquid purge, and is also a part of a suction mechanism for carrying out the first air discharge purge and the high-speed suction upon being connected to the air discharge channel 66.

The high-speed suction in the second purge mode is strictly (purely) aimed at destroying the meniscus in the nozzle by reducing cowering) rapidly the pressure inside the liquid supply channel, and it is not necessary to make a suction time that long. Accordingly, when not only the degree of thickening of the liquid inside the nozzle is extreme but also an amount of a gas entered into the liquid supply channel is substantial (large), sometimes, it is not possible to discharge sufficiently the gas inside the liquid supply channel, only by carrying out the second purge mode. Therefore, in such case, by carrying out the first air discharge purge after the high-speed suction as described above and the liquid purge are carried out, the gas inside the liquid supply channel is discharged assuredly.

Next, the control unit 8 which carries out the overall control of the printer 1 will be described below. FIG. 5 is a block diagram showing an electrical structure of the printer 1. The control unit 8 shown in FIG. 6 includes a central processing unit (CPU), a read only memory (ROM) in which various computer programs and data for controlling the overall operation of the printer are stored, and a random access memory (RAM) which temporarily stores data etc. to be processed by the CPU. The control unit 8 may be a unit which caries out various controls described below by the computer programs stored in the ROM being executed by the CPU. Or, the control unit 8 may be a hardware unit in which various circuits including an arithmetic circuit are combined.

The control unit 8 (a control mechanism, controller) includes a recording control section 81 and a maintenance control section 82. The recording control section 81, based on data input from an input unit (an input device) 84 such as a PC (a personal computer), controls components such as the carriage driving motor 19 which is driven to reciprocate the carriage 2, the head driver 53 of the ink-jet head 3, the paper feeding motor 27 and the paper discharging motor 28, which transports the recording paper P, and makes the ink-jet head 3 carry out recording of an image etc. on the recording paper P. Moreover, the maintenance control section 82 makes carry out a series of maintenance operations (a liquid droplet jetting performance recovery operation) including operations such as the liquid purge and the first air discharge purge described above, by controlling various components of the maintenance unit 7 such as the suction cap driving motor 91, the air discharge cap driving motor 92, and the suction pump 14.

Furthermore, a maintenance operation of the maintenance unit 7 which is controlled by the maintenance control section 82 will be described below in further detail.

In a case in which the printer 1 has not been used for a long time, when the ink is not jetted from the nozzles 40 for a long period of time, the ink inside the nozzles 40 become thickened due to drying. According to the degree of thickening of the ink, sometimes it is quite difficult to discharge the thickened ink inside the nozzle 40 only by carrying out the liquid purge (ink suction discharge from the nozzles 40) described above. Therefore, the maintenance control section 82, for discharging the thickened ink and an air bubble, is capable of carrying out selectively the normal purge mode (the first purge mode) in which the first air discharge purge and the liquid purge are carried out, and a purge mode of carrying out the high-speed suction and the liquid purge, which is which is particularly for discharging the thickened ink when the degree of thickening of the ink is extreme, according to the degree of thickening of the ink inside the nozzles 40.

Figure 6:
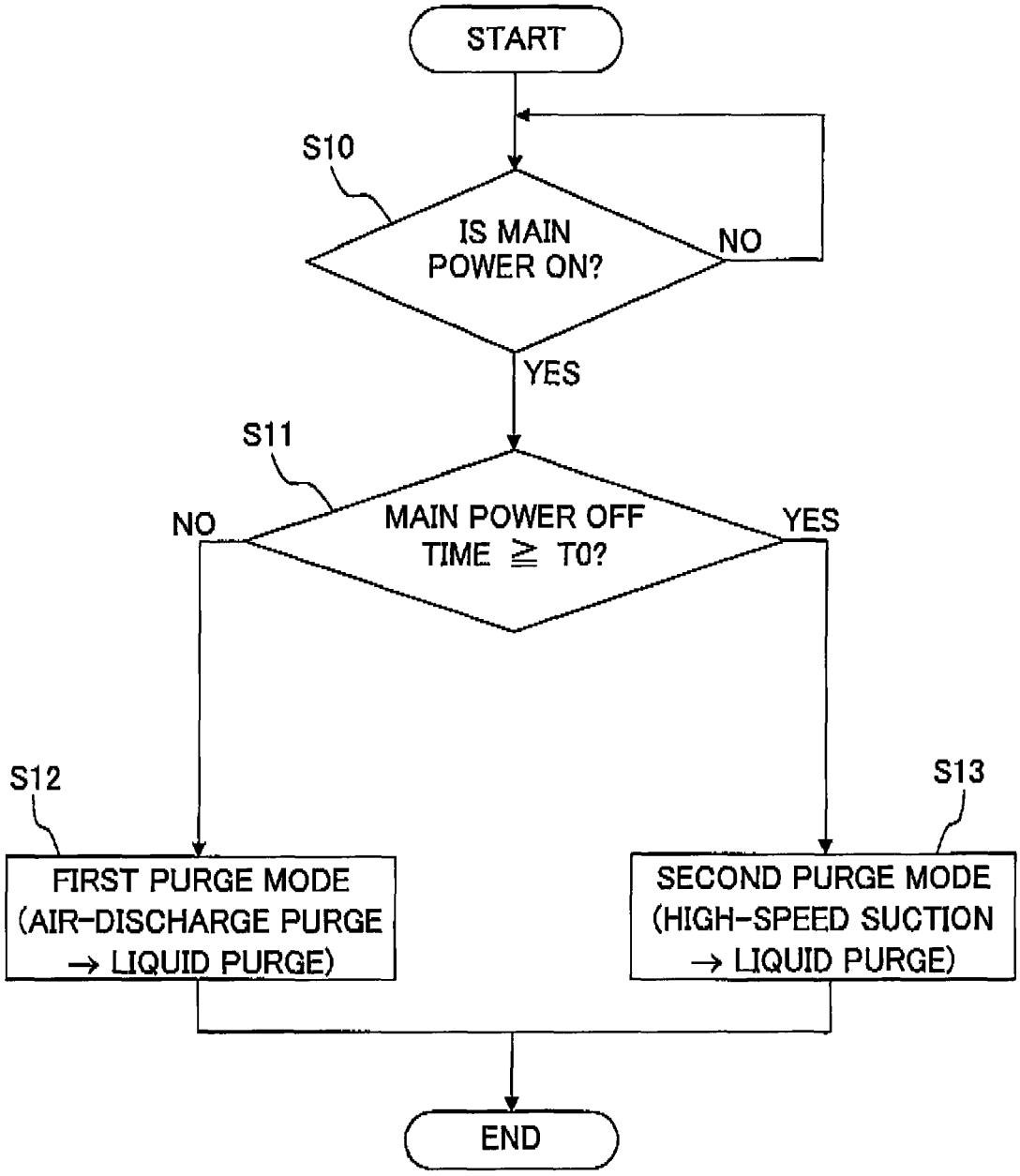

The following description is made by citing an example of the suction purge immediately after the power supply is switched on, for discharging the ink thickened due to drying when the power supply of the printer 1 had been switched off (for a long period of time). FIG. 6 is a flowchart related to a maintenance operation to be carried out immediately after the power supply is switched on. In FIG. 6, Si (where i=10, 11, 12, . . . ) indicate various steps.

It is not shown in the diagram in particular, but the printer 1 of the embodiment includes a main power supply (an apparatus power supply) which supplies an electric power to the main components such as the ink-jet head 3, and an auxiliary power supply (such as a battery) which supplies an electric power to some of the components of the printer including a timer, when the main power supply is OFF. Therefore, it is made possible to measure a time for which the main power supply has been switched off, by the timer which is operated by the auxiliary power supply.

As shown in FIG. 6, when the main power supply has been switched on after being in a switched off-state (step S10), and when a time for which the main power supply had been OFF measured by the timer is shorter than predetermined time T0 (such as about one month) (No at step S11), then the maintenance control section 82 selects the first purge mode and makes the maintenance unit 7 carry out the first purge mode.

When the first purge mode is selected, the maintenance control section 82 makes the maintenance unit 7 carry out the liquid purge, after making the maintenance unit 7 carry out the first air discharge purge.

Figure 7A:
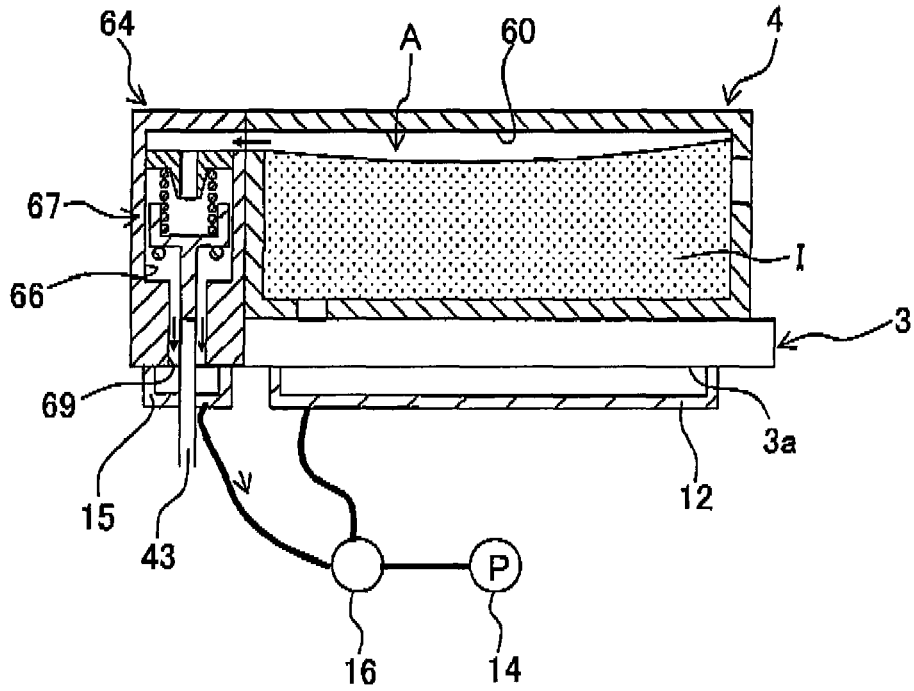

Firstly, as shown in FIG. 7A, the air discharge cap 15 is moved upward and brought in a close contact with the lower surface of the air discharge unit 64, and the air discharge port 69 is closed by the air discharge cap 15. Next, by moving the open-close member 43 upward with respect to the air discharge cap 15, the valve disc 72 of the opening and closing valve 67 is separated away from the valve-seat surface 75, and the air discharge channel 66 is opened. In a state of the air discharge channel 66 opened, the suction pump 14 is made to carry out the suction operation after making the suction pump 14 communicate with the air discharge cap 15 by the switching unit 16. Accordingly, by reducing (lowering) the pressure in the sealed space formed by the air discharge cap 15 and the lower surface of the air discharge unit 64, the air inside the ink storage chamber 60 of the sub tank 4 (indicated by a reference numeral A) is discharged to the air discharge cap 15 through the air discharge channel 66 (first air discharge purge). In the first air discharge purge, mainly the air is discharged through the air discharge channel 66, however, a part of the ink in the ink storage chamber 60 mixed with the air may be discharged.

Moreover, at the time of carrying out the first air discharge purge, it is preferable to cover the jetting ports of the nozzles 40 by bringing also the suction cap 12 in a close contact with the liquid droplet jetting surface 3*a*. Accordingly, when the pressure inside the ink storage chamber is reduced by the first air discharge purge, it is possible to prevent the meniscus of the ink in the nozzle 40 from being destroyed.

Figure 7B:
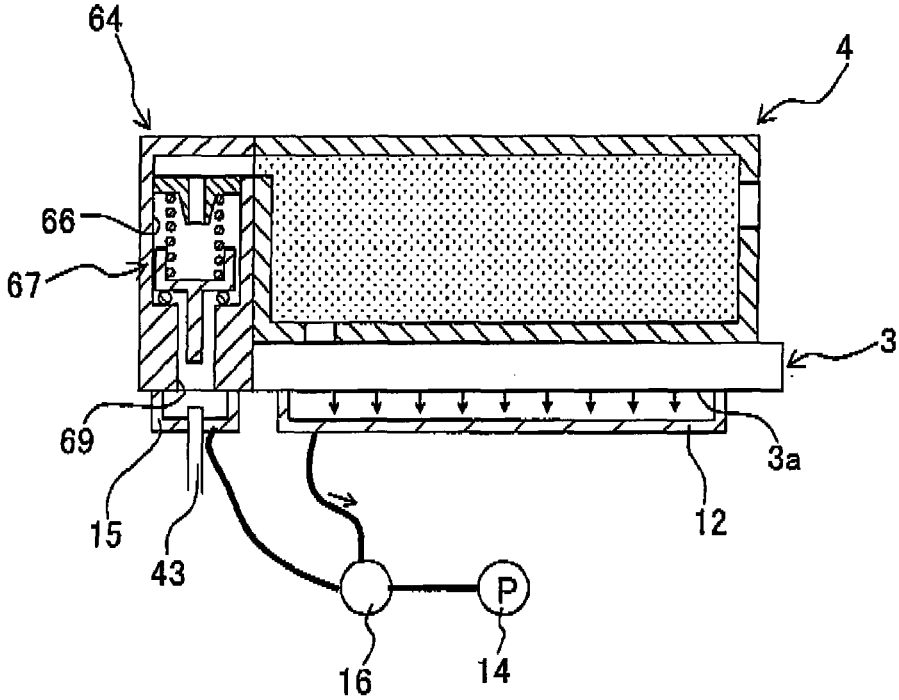

Next as shown in FIG. 7B, after closing the air discharge channel 66 by moving the open-close member 43 downward, and switching the destination of communication of the suction pump 14 from the air discharge cap 15 to the suction cap 12 by the switching unit 16, the suction pump 14 is made to carry out the suction operation. Accordingly, when the pressure inside the sealed space formed by the suction cap 12 and the liquid droplet jetting surface 3*a* of the ink-jet head 3 is reduced, the ink is discharged from the nozzles 40 (liquid purge). At this time, the thickened ink inside the nozzles 40, and an air bubble or dust entered into the ink is discharged together with the ink. In the first purge mode, the liquid purge is not required to be carried out necessarily after the first air discharge purge. When it is apparent that the ink inside the nozzles 40 is not thickened, the liquid purge may be omitted.

In FIG. 6, when the time for which the main power supply had been OFF measured by the timer is not less than the predetermined time T0, or in other words, when the power supply is switched on after the main power supply had not been switched on for the time not less than the predetermined time T0 (Yes at step S11), the maintenance control section 82 selects the second purge mode for discharging more assuredly, the thickened ink inside the nozzles, and makes the maintenance unit 7 carry out the second purge mode (step S13).

When the second purge mode is selected, the maintenance control section 82 makes the maintenance unit 7 carry out the liquid purge after making the maintenance unit 7 carry out the high-speed suction in which the suction speed is more than the suction speed in the first air discharge purge.

Figure 8A:
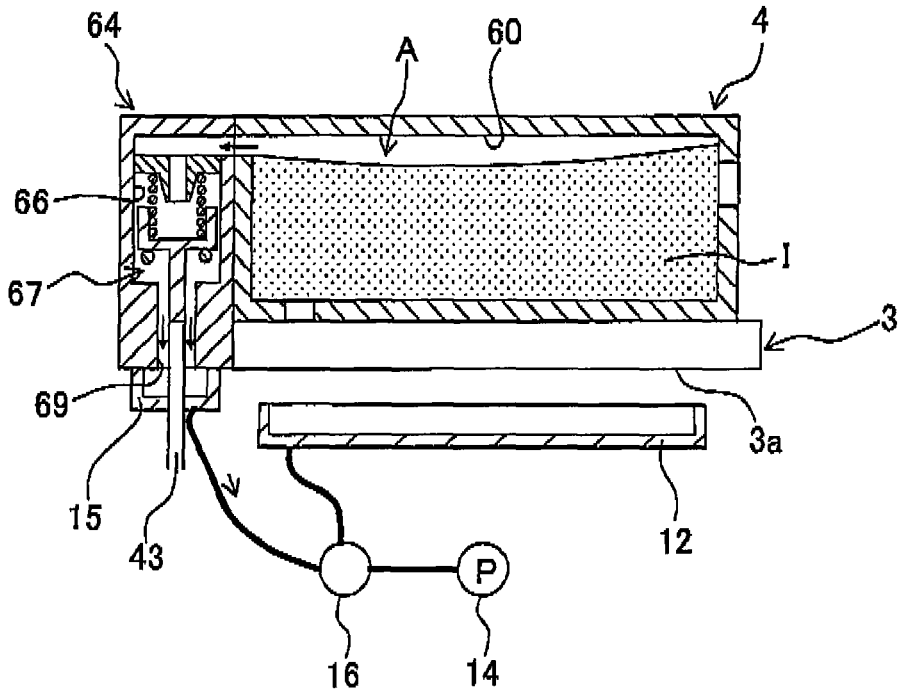
Figure 8B:
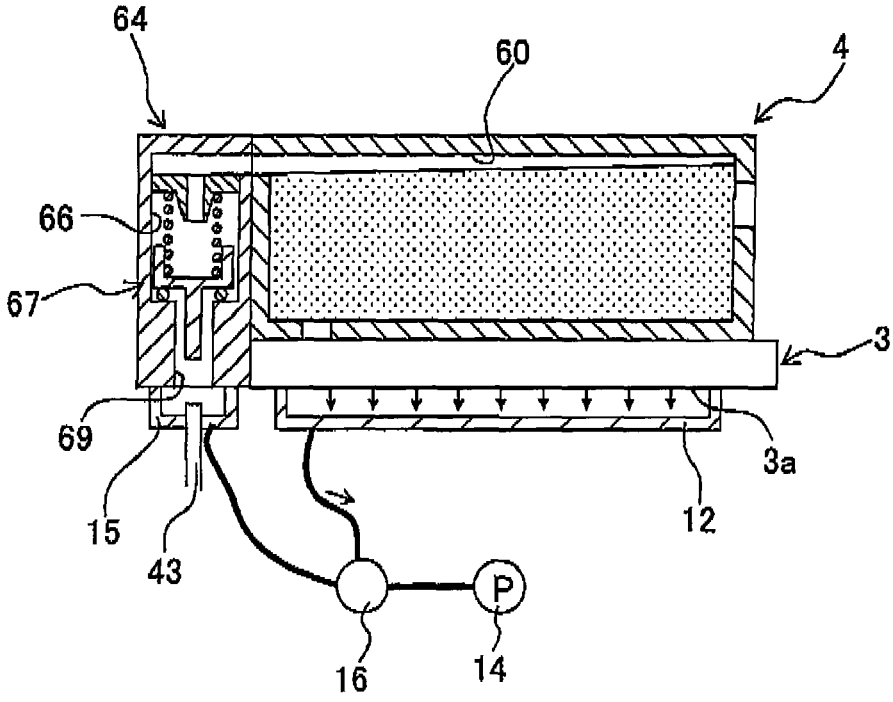
Figure 9:
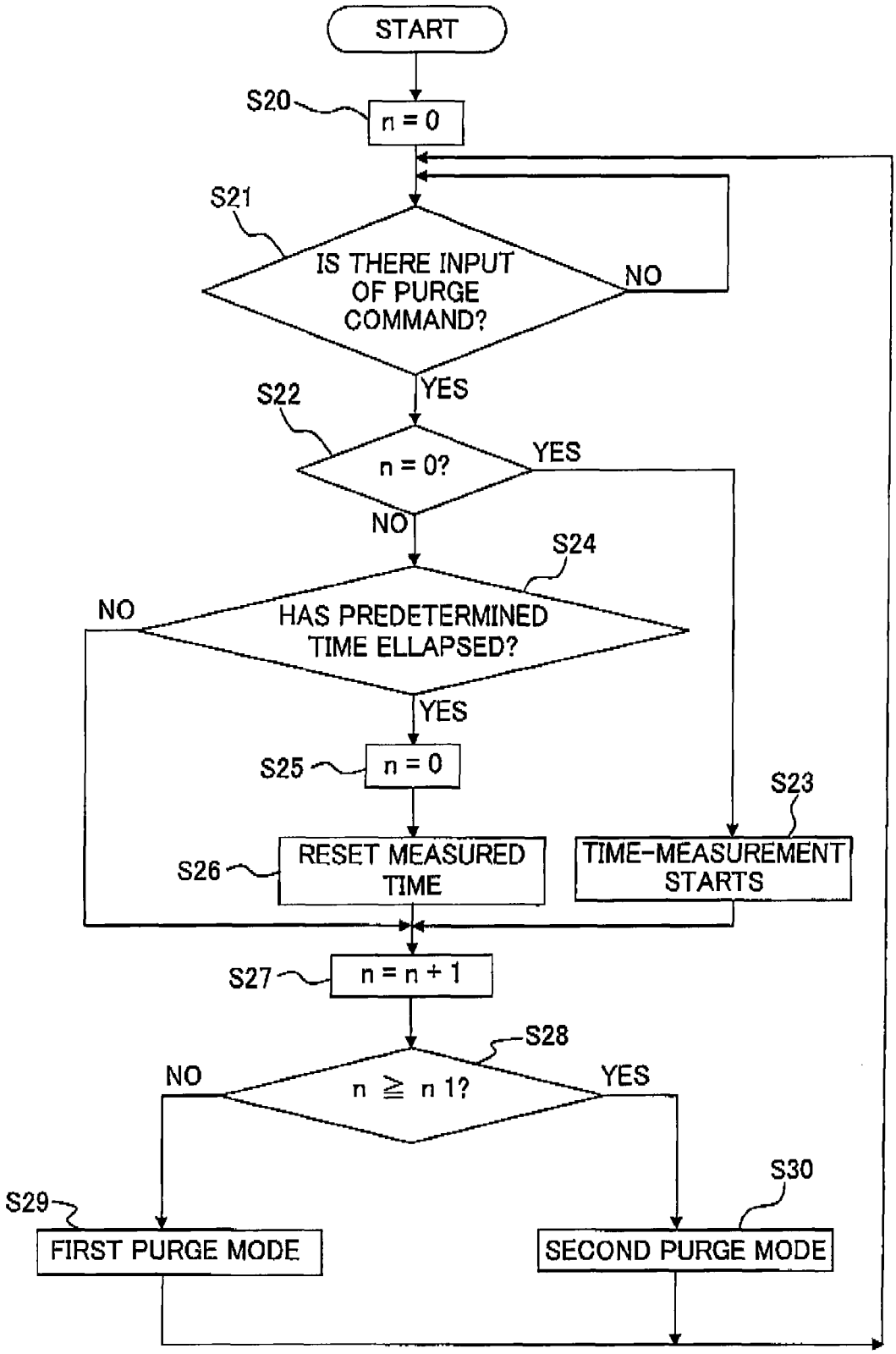
FIG. 9 is a flowchart of a maintenance operation in a first modification.

In both the high-speed suction of the second purge mode, and the first air discharge purge of the first purge mode, as shown in FIG. 8A, the air discharge cap 15 closes the air discharge port 69 of the air discharge unit 64, and further, the open-close member 43 opens the air discharge channel 66 by driving the valve disc 72 upward. In this state, the suction pump 14 is made to carry out the suction operation in the air discharge cap 15.

However, in the high-speed suction, the suction speed of the suction pump 14 (an amount air sucked per unit time) is made substantially larger than that in the first air discharge purge (for example, about ten times that of the first air discharge purge). It is possible to realize a change in the suction speed of the suction pump 14 easily by changing the frequency of rotation (the number of revolutions) (per unit time) by adjusting a gear ratio, in a case of a rotary pump for example.

In this manner, when the suction pump 14 is made to carry out suction at a high speed, the pressure inside the ink storage chamber 60 communicating with the air discharge channel 66 is reduced rapidly. As the pressure is reduced rapidly, a pressure inside the nozzle 40 positioned at an extreme end of the ink channel in the ink-jet head 3 communicating with this ink storage chamber 60 is also reduced rapidly, thereby disturbing a balance (an equilibrium) with an atmospheric pressure which acts from outside of the jetting port of the nozzle 40, and the meniscus of the thickened ink inside the nozzle 40 is destroyed.

Here, a diameter of the nozzle 40 is smaller than a diameter of the air discharge hole (port) 69, and a total channel resistance of the individual ink channel 41 is more than a channel resistance of the air discharge channel 66. Therefore, by carrying out the suction from the air discharge channel side rather than by carrying out the suction from the nozzle side, it is possible to suck the ink and the air bubble more efficiently, and it is possible to destroy the meniscus of the thickened ink inside the nozzle 40.

It is preferable to carry out the high-speed suction in a state of the suction cap 12 separated away from the liquid droplet jetting surface 3*a* of the ink-jet head 3. In this case, the atmospheric pressure acts on the meniscus inside the nozzle 40 all the time. Whereas, when the suction cap 12 covers the liquid droplet jetting surface 3*a* of the ink-jet head 3 to be airtight and when a level of the ink has moved in a direction of being pulled in from a front end of the nozzle 40 with the high-speed suction, a negative pressure is developed inside the suction cap 12. In this case, since a pressure acting on the meniscus from the outside of the nozzle 40 becomes lower than the atmospheric pressure, as compared to a case in which the liquid droplet jetting surface 3*a* is not covered to be airtight by the suction cap 12 (when the liquid droplet jetting surface 3*a* is open to the atmosphere), the meniscus of the thickened ink inside the nozzle 40 is hardly destroyed.

Next, the liquid purge is carried out after the high-speed suction. In other words, as shown in FIG. 5B, at first, the air discharge channel 66 is closed when the open-close member 43 is moved downwards. Then, the suction pump 14 is controlled to suck the air in the suction cap 12 after closing the jetting ports of the nozzles 40 by bringing the suction cap 12 in a close contact with the liquid droplet jetting surface 3*a*, and the liquid is discharged from (through) the nozzles 40. Here, since the meniscus of the thickened ink inside the nozzle 40 is destroyed once by the high-speed suction carried out earlier, it is possible to discharge the thickened ink inside the nozzles 40 by the liquid purge. Moreover, when the high-speed suction was carried out, the level of the ink has moved from the front end of the nozzle 40 to a substantial (much) upstream side of the individual ink channel 41. By carrying out the liquid purge in continuity with the high-speed suction, it is possible to fill up the individual ink channel 41 by ink again, and to form a meniscus at the front end of the nozzle 40.

For switching the two purge modes according to the time for which the power supply has been switched off as mentioned above, the printer 1 is not necessarily required to include a timer which measures the time for which the power supply had been switched off. For instance, an approximate period of time for which the power supply had been switched off may be asked to the user at the time of putting the power supply ON, and the purge mode may be switched to one of the two purge modes based on information achieved from the user.

Next modifications in which various modifications are made in the embodiment will be described below. However, same reference numerals are assigned to components which have a similar structure as in the embodiment, and description of such components is omitted appropriately.

First Modification

In the embodiment, as an example of selecting one of the first purge mode and the second purge mode, switching according to the period of time for which the power supply had been switched off is cited. However, the method for selecting the purge mode is not restricted to the switching according to the time for which the power supply had been switched off.

For example, a purge command may be input by the user who has ascertained upon looking an image recorded practically, that a printing quality has degraded. In other words, when a purge command is input to the control unit 8 from an external input unit (external input device) such as a PC connected to the printer 1, or from an operation panel of the printer 1, the maintenance control section 82 may carry out the switching of the purge mode depending on whether or not the command has been input repeatedly during a predetermined time. In other words, when a frequency of input n of inputting the purge command from an outside during the predetermined period is less than a predetermined frequency n1 (where n1 is an integer not less than 2), the maintenance unit 7 is made to carry out the first purge mode. When the frequency of input n of inputting the purge command is not less than the predetermined frequency n1, the maintenance unit 7 is made to carry out the second purge mode.

Firstly, in an initial setting after the main power supply of the printer 1 has been switched on, input frequency n of inputting the purge command repeatedly is cleared to zero (step S20).

When the purge command is input from the outside (Yes at step S21) and the purge command is the first purge command after the power supply is switched on, in other words, when the input frequency n is 0 (Yes at step S22), then the timer starts for measuring time since the first purge command, and then the process advances to step S27. Moreover, when the input of the purge command has already been carried out in the past, and $n \neq 0$ (No at step S22), and further, when the time elapsed after the first purge command measured by the timer is less than the predetermined period of time (such as about an hour) (No at step S24), then the process advances to S27. On the other hand, when the time not less than the predetermined period of time has elapsed after the first purge command (Yes at step S24), the input frequency is cleared to zero (step S25) and the time measured by the timer (step S26) is reset such that the input frequency of inputting repeatedly can be counted once again from the purge command at that time. Then, the process advances to step S27. At step S27, the input frequency n is incremented.

Next at step S28, the input frequency n of the purge command is compared with a predetermined repeated frequency n1 (a predetermined input frequency of repeatedly inputting the purge command). When n is less than n1 (No at step S28), a judgment is made that a request for the purge command has not been made repeatedly at frequent intervals during the predetermined period, and the first purge mode is selected (step S29). On the other hand, when n is not less than n1 (Yes at step S28), it leads to a judgment that the first purge mode has been repeated for a number of times during a short period of time. In this case, even when the first purge mode is carried out repeatedly, a judgment is made that the jetting defect of the nozzle 40 has not yet been eliminated since the thickening is extreme, and the second purge mode is selected (step S30). When one of the first purge mode and the second purge mode ends, the process returns to step S21.

Alternatively, the first purge mode which includes the first air discharge purge may be selected, when a judgment is made that an air bubble is susceptible to enter the ink supply channel, including the tubes 11 and the ink storage chamber 60 in the sub tanks 4*a* to 4*d* and ranging from the ink cartridge 6*a* to 6*d* up to the ink-jet head 3. For instance, at the time of installing/removing the ink cartridge 6 on/from the holder 10, air is susceptible to enter from a connecting portion of the holder 10 and the ink cartridge 6, and it can be said to be a state in which the air is susceptible to enter the ink supply channel.

In this case, for example, when an operation of attaching or detaching the ink cartridge 6 is detected by the cartridge detecting sensor 90 (refer to FIG. 5), the first purge mode can be selected.

Or, when the purge command is input from the outside (such as from the user) immediately after the recording on the recording paper P is carried out, a judgment is made that the jetting defect of the nozzle 40 at that time is not due to the entry of an air bubble, but is due to the thickened ink existing inside the nozzle 40, and the second purge mode which includes the high-speed suction may be selected.

Moreover, it is possible to select a purge mode in which only the first air discharge purge is carried out or a purge mode in which only the liquid purge is carried out, apart from the first purge mode which includes two stages namely the first air discharge purge and the liquid purge, and the second purge mode which includes two stages namely the high-speed suction and the liquid purge.

Second Modification

The high-speed suction carried out in the second purge mode which is selected when the degree of thickening of the ink inside the nozzle 40 is extreme (refer to FIG. 8A), is only aimed at destroying the meniscus in the nozzle 40 by reducing rapidly the pressure inside the ink storage chamber 60. When only this object is to be achieved, it is not necessary to make the suction time that long, and the suction operation in which the suction speed (suction force) is high is to be carried out only for a short time. However, in such high-speed suction with such a short suction time, an amount of air (gas) which is discharged from the air discharge channel 66 is small. Therefore, when the thickening of the ink inside the nozzle 40 is extreme and also mixing (entry) of air into the ink storage chamber 60 is substantial, sometimes it is not possible to discharge sufficiently the air inside the ink storage chamber 60 only by carrying out the second purge mode which includes the two stages namely the high-speed suction and the liquid purge.

However, when the high-speed suction is carried out for a long time not only for destroying the meniscus in the nozzle 40 by the high-speed suction, but also to be able to discharge the air inside the ink storage chamber 60, a large amount of air flows reversely into the ink-jet head 3 from the jetting port of the nozzle 40 having the meniscus destroyed. In this case, it becomes difficult to discharge completely the air which has flowed reversely by the liquid purge after the high-speed suction.

Therefore, when the thickening of the ink inside the nozzle 40 is extreme, and when an amount of air entering from the outside is presumed to be large, it is preferable to discharge assuredly the air inside the ink storage chamber by further carrying out the first air discharge purge at the suction speed smaller than the high-speed suction, and having a suction time longer than the (time of) the high-speed suction, after the second purge mode (high-speed suction and the liquid purge) is carried out. For instance, when the state in which the power supply has not been switched on is continued for a long time as it has been cited in the embodiment, not only the drying (thickening) of the ink inside the nozzle 40 advances but also the entry of air into the ink advances in the tube 11 made of a gas-permeable material such as a synthetic resin material. Therefore, for example, when the power supply is switched on after the apparatus power supply had not been switched on for more than a certain period of time, the maintenance control section 82 may make the maintenance unit 7 carry out the second purge mode, and further thereafter, may make the maintenance unit 7 carry out the first air discharge purge.

Third Modification

One suction pump 14 is not necessarily required to carry out both the suction discharge of the ink from the nozzle 40, and the suction discharge of the air from the air discharge channel 66. Separate suction pumps may carry out the suction from the nozzle 40, and the suction from the air discharge channel 66.

Moreover, the discharge of the ink from the nozzle 40 is not restricted to the suction by the suction pump. In other words, a pressurizing pump (a purge mechanism) may be connected to the ink supply channel including the ink storage chamber 60 and the tube 11, and the ink may be ejected from (through) the nozzle by pressurizing the ink inside the ink supply channel by this pump.

Fourth Modification

Figure 10:
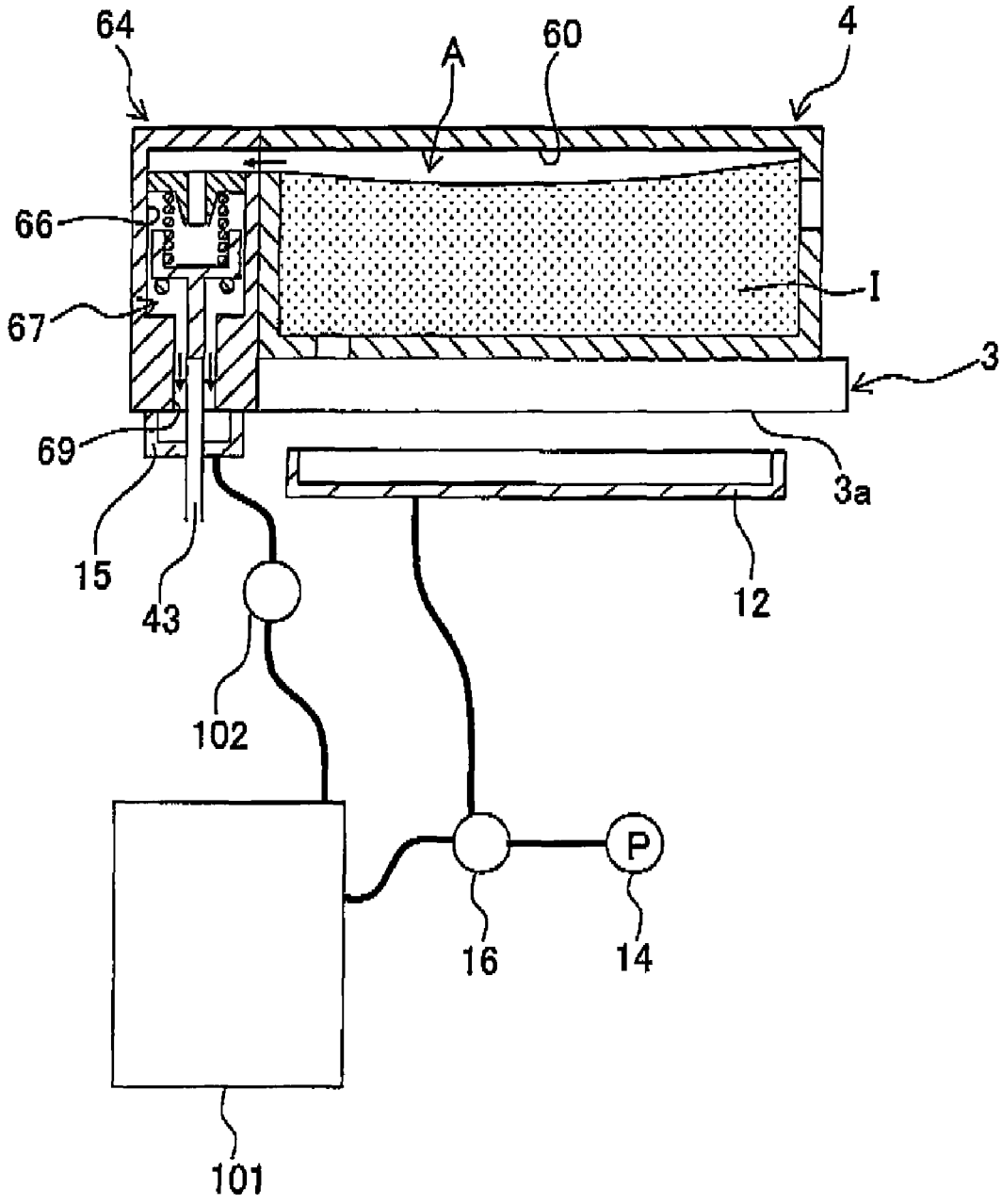
FIG. 10 is a diagram of a fourth modification, corresponding to FIG. 2.

The second air discharge purge is not restricted to the high-speed suction in which the suction pump 14 is driven such that the suction is at a speed higher than the (suction speed of the) first air discharge purge. As long as the gas (and the ink) is sucked from the air discharge channel in order to destroy the meniscus of the ink formed at the front end of the nozzle 40, it may be another mode. As an example thereof, another mode of the second air discharge purge in which a vacuum buffer-tank is used will be described below. As shown in FIG. 10, a vacuum buffer-tank 101 is arranged between the air discharge cap 15 and the switching unit 16, and an valve 102 is arranged at an upstream side (toward the air discharge cap) of the vacuum buffer-tank 101. Firstly, in a state of the valve 102 closed, an interior of the vacuum buffer-tank is depressurized until a predetermined degree of vacuum is achieved. Next, by opening the valve 102, an interior space of the air discharge cap 15, and the air discharge channel 66 are made to communicate with the vacuum buffer-tank 101. At this time, when a volume of the vacuum buffer-tank 101 is sufficiently larger than a volume of the interior space of the air discharge cap 15, and the air discharge channel 66, it is possible to reduce an internal pressure of the interior space of the air discharge cap 15, and the air discharge channel 66 up to an internal pressure inside the vacuum buffer-tank 101.

In this case, as it has been mentioned above, in the first air discharge purge and the second air discharge purge, it is not necessary to change the suction speed of the suction pump 14. In the second air discharge purge, the pressure inside the vacuum buffer tank 101 is to be set such that it is possible to destroy the meniscus of the ink, which is formed at the front end of the nozzle 40. Concretely, the vacuum buffer tank 101 which communicates with the air discharge channel 66 via the valve 102 is depressurized such that a pressure difference between the atmospheric pressure exerted to the front end of the nozzle 40, and the pressure of the air discharge channel 66 is higher than the withstand pressure (resisting pressure) of the meniscus. Whereas, in the first air discharge purge, the pressure inside the vacuum buffer tank O1 may be set such that the meniscus of the ink formed at the front end of the nozzle 40 is not destroyed.

The vacuum buffer-tank and the valve may not be necessarily arranged between the air discharge cap 15 and the switching unit 16. For instance, the vacuum buffer-tank and the valve may be arranged between the switching unit 16 and the suction pump 14. In this case, at the time of carrying out the liquid purge, it is possible to adjust a pressure inside the sealed space formed by the suction cap 12 and the liquid droplet jetting surface 3*a* of the ink-jet head 3, by adjusting the pressure of the vacuum buffer-tank. Moreover, when the vacuum buffer-tank is arranged between the air discharge cap 15 and the switching unit 16, the valve 102 is not required necessarily, and the valve 67 may serve also as the valve 102.

In the embodiment and the modifications described above, the first air discharge purge, the liquid purge, and the second air discharge purge may be carried out simultaneously for all the inks, or may be carried out separately for each ink. Moreover, when a nozzle diameter, a channel resistance of the individual channel and a channel resistance of the air discharge channel differ for each color, and when a viscosity of the ink differs substantially for each color, the suction force which is necessary for the first air discharge purge, the liquid purge, and the second air discharge purge may vary for each color. In such a case, the first air discharge purge, the liquid purge, and the second air discharge purge may be carried out while changing conditions such as the suction speed, according to each ink system. Moreover, in the embodiment and the modifications described above, one suction pump has been used combindly in the suction mechanism and the purge mechanism. However, each of the suction mechanism and the purge mechanism may have an independent suction pump.

In the embodiment and the modifications described above, the present invention is applied to an ink-jet printer which records image etc. by jetting inks on to a recording paper. However, the application of the present invention is not restricted to such application. In other words, the present invention is also applicable to various liquid droplet jetting apparatuses which jet various types of liquids other than ink according to an application, which may be thickened due to mixing (entry) of air therein, or due to drying.

What is claimed is:

1. A liquid droplet jetting apparatus which jets droplets of a liquid, comprising:

a liquid droplet jetting head having nozzles which jet the liquid droplets, and in each of which a meniscus of the liquid is formed at an end of the each of the nozzles;

a liquid supply channel through which the liquid is supplied to the liquid droplet jetting head;

an air-discharge channel which communicates with the liquid supply channel;

a purge mechanism which performs a liquid purge of discharging the liquid from the nozzles of the liquid droplet jetting head;

a suction mechanism which is connected to the air discharge channel so as to suck air through the air discharge channel; and a controller which controls the purge mechanism and the suction mechanism to selectively perform a first purge mode in which the control mechanism controls the suction mechanism to perform a first air-discharge purge of discharging an air inside the liquid supply channel via the air-discharge channel while maintaining the meniscus of the liquid in the nozzles, and a second purge mode in which the control mechanism controls the suction mechanism to perform a second air-discharge purge of discharging the air inside the liquid supply channel via the air-discharge channel while destroying the meniscus of the liquid in the nozzle and then the control mechanism controls the purge mechanism to perform the liquid purge.

2. The liquid droplet jetting apparatus according to claim 1;

wherein the controller, in the first purge mode, controls the purge mechanism to perform the liquid purge after controlling the suction mechanism to perform the first air-discharge purge.

3. The liquid droplet jetting apparatus according to claim 2;

wherein the controller, in the second air discharge purge, controls the suction mechanism to perform a high-speed suction with a suction speed greater than a suction speed in the first air-discharge purge.

4. The liquid droplet jetting apparatus according to claim 3;

wherein when the second purge mode is selected, the controller controls the suction mechanism to perform the high-speed suction, and then controls the purge mechanism to perform the liquid purge, and then controls the suction mechanism to perform the first air-discharge purge.

5. The liquid droplet jetting apparatus according to claim 3;

wherein when the liquid droplet jetting apparatus is switched on after the liquid droplet jetting apparatus has not been switched on for a period of time which is greater than a predetermined period of time, the controller selects the second purge mode.

6. The liquid droplet jetting apparatus according to claim 3;

wherein the controller is capable of receiving a purge instruction from an outside of the liquid droplet jetting apparatus or from an input device which is arranged in the liquid droplet jetting apparatus; and when the controller receives the purge instruction for more than a predetermined number of times in a predetermined time period, the control unit selects the second purge mode.

7. The liquid droplet jetting apparatus according to claim 1;

wherein the liquid supply channel includes a main tank which stores the liquid, and a sub tank which communicates with the main tank, and which stores a part of the liquid to supply the liquid to the liquid droplet jetting head, the sub tank communicating with the air discharge channel; and wherein the liquid droplet jetting apparatus further comprises a carriage on which the liquid droplet jetting head, the sub tank and the air discharge channel are provided, and which is movable in a predetermined direction.

8. The liquid droplet jetting apparatus according to claim 1;

wherein the purge mechanism includes a cap capable of covering a surface of the liquid droplet jetting head, in which the nozzles are formed, such that the cap covers the surface of the liquid droplet jetting head air-tightly; and when the first air discharge purge is performed, the cap covers the surface of the liquid droplet jetting head, in which the nozzles are formed, such that the surface of the liquid droplet jetting head is air tight; and when the second air discharge purge is performed, the surface of the liquid droplet jetting head, in which the nozzle are formed, is opened to atmosphere.

9. The liquid droplet jetting apparatus according to claim 1;

wherein the suction mechanism has a pump, a chamber having a volume greater than a volume of the air discharge channel and provided between the pump and the air discharge channel, and a valve which opens and closes a space between the chamber and the air discharge channel; and in the first purge mode, the controller controls the suction mechanism to reduce, in a state that the valve is closed, a pressure, in the chamber such that a pressure difference between the pressure in the chamber and an atmospheric pressure is reduced up to a first pressure which is lower than a withstand pressure of the meniscus of the liquid, and then the controller controls the suction mechanism to open the valve to communicate the chamber and the air discharge channel with each other; and in the second purge mode, the controller controls the suction mechanism to reduce, in a state that the valve closed, the pressure in the chamber such that the pressure difference between the pressure in the chamber and the atmospheric pressure is reduced up to a second pressure which is higher than the withstand pressure of the meniscus of the liquid, and then the controller opens the valve to communicate the chamber and the air discharge channel with each other.

10. The liquid droplet jetting apparatus according to claim 5, further comprising:

a timer which measures a period of time during which the liquid droplet jetting apparatus has not been switched on; and an auxiliary power supply which supplies an electric power to the timer during the period of time the liquid droplet jetting apparatus is not switched on.

11. The liquid droplet jetting apparatus according to claim 3;

wherein the suction mechanism has a rotary suction pump; and when the controller controls the suction mechanism to perform the second air discharge purge, the controller controls the suction mechanism such that a number of revolutions per unit time of the suction pump is greater than that when the first air discharge purge is performed.

* * * * *